US007650757B2

(12) United States Patent
Bhatti

(10) Patent No.: US 7,650,757 B2
(45) Date of Patent: Jan. 26, 2010

(54) THERMOELECTRIC HEAT TRANSFER SYSTEM

(75) Inventor: Mohinder Singh Bhatti, Amherst, NY (US)

(73) Assignee: Delphi Technologies, Inc., Troy, MI (US)

( * ) Notice: Subject to any disclaimer, the term of this patent is extended or adjusted under 35 U.S.C. 154(b) by 660 days.

(21) Appl. No.: 11/041,819

(22) Filed: Jan. 24, 2005

(65) Prior Publication Data

US 2006/0162342 A1 Jul. 27, 2006

(51) Int. Cl.
*F25B 21/02* (2006.01)

(52) U.S. Cl. ..... 62/3.64; 62/3.1; 62/3.7; 62/96; 62/457.4; 62/457.5; 62/3.2; 62/3.5; 165/80.4

(58) Field of Classification Search ..... 62/3.7, 62/6, 457.9, 96, 239, 275, 62, 3.64, 3.1, 3.2, 62/457.4, 3.5, 457.5, 457; 219/501, 689; 165/80.6; 220/592.17; 257/205
See application file for complete search history.

(56) References Cited

U.S. PATENT DOCUMENTS

| | | | | |
|---|---|---|---|---|
| 3,097,027 | A * | 7/1963 | Mims et al. | 384/476 |
| 5,316,078 | A | 5/1994 | Cesaroni | 165/104.33 |
| 5,385,020 | A * | 1/1995 | Gwilliam et al. | 62/3.7 |
| 5,653,111 | A | 8/1997 | Attey et al. | 62/3.7 |
| 5,737,923 | A | 4/1998 | Gilley et al. | 62/3.7 |
| 6,003,319 | A | 12/1999 | Gilley et al. | 62/3.7 |
| 6,082,114 | A * | 7/2000 | Leonoff | 62/3.64 |
| 6,276,753 | B1 | 8/2001 | Sur et al. | 297/188.19 |
| 6,530,232 | B1 | 3/2003 | Kitchens | 62/3.3 |
| 6,548,750 | B1 * | 4/2003 | Picone | 136/203 |
| 6,675,588 | B2 | 1/2004 | Rudick | 62/6 |
| 2003/0145605 | A1 * | 8/2003 | Moon et al. | 62/3.2 |

FOREIGN PATENT DOCUMENTS

| | | |
|---|---|---|
| WO | 98/37369 | 8/1998 |

* cited by examiner

*Primary Examiner*—Frantz F Jules
*Assistant Examiner*—Azim Rahim
(74) *Attorney, Agent, or Firm*—Patrick M. Griffin

(57) ABSTRACT

A thermoelectric heat transfer system is provided. The thermoelectric heat transfer system comprises a coolant circuit with a pump circulating coolant through the circuit. A first heat exchanger is in fluid communication with the coolant circuit to remove heat from the coolant. At the same time, a second heat exchanger is in fluid communication with the coolant circuit. Thermoelectric modules (TEMs) are integrated into the second heat exchanger to create a temperature differential between fins and conduits of the second heat exchanger. The coolant flows through the conduits to draw heat from the TEMs, while a fan assembly conveys air through the fins into a climate-controlled area to cool the climate-controlled area to a desired temperature. In other embodiments, a sleeve acts as the second heat exchanger. The sleeve is adapted to receive and cool beverage containers and like items.

9 Claims, 5 Drawing Sheets

THERMOELECTRIC HEAT TRANSFER SYSTEM

FIELD OF THE INVENTION

The present invention relates to a thermoelectric heat transfer system for use in establishing a desired temperature in a climate-controlled area. More specifically, the present invention relates to the use of the thermoelectric heat transfer system for refrigeration of items such as beverage containers in coolers, vending machines, and the like.

BACKGROUND OF THE INVENTION

Thermoelectric heat transfer systems are well known for use in refrigeration. A typical thermoelectric heat transfer system includes at least one thermoelectric module to create a temperature differential. More specifically, when energized, heat moves across the thermoelectric module to form a hot surface and a cold surface. The cold surface provides the cooling needed for refrigeration.

In recent years, improvements have been made to utilize coolant circuits to draw heat off of the hot surface of the thermoelectric module to further improve the efficiency of refrigeration. Referring to U.S. Pat. No. 5,653,111 to Attey et al., a thermoelectric heat transfer system utilizing a coolant circuit for this purpose is shown. In Attey et al., the thermoelectric heat transfer system includes a pump in fluid communication with the coolant circuit to circulate coolant. A first heat exchanger is disposed in fluid communication with the coolant circuit to remove heat from the coolant being circulated. At the same time, a manifold is in fluid communication with the coolant circuit. An outer surface of the manifold is in contact with a hot surface of a thermoelectric module. By thermally connecting the coolant circuit with the hot surface of the thermoelectric module, the coolant can draw heat from the hot surface to improve the cooling efficiency of the thermoelectric module. The cold surface of the thermoelectric module is in contact with an outer surface of a second manifold to cool fluid flowing through the second manifold.

Thermoelectric heat transfer systems for cooling beverage containers are also well known in the art. A typical heat transfer system for cooling a beverage container includes a sleeve adapted to receive the beverage container. In these systems, the thermoelectric module is disposed within the sleeve to create a temperature differential between the sleeve and the beverage container. More specifically, a hot surface of the thermoelectric module is in contact with the sleeve, while a cold surface of the thermoelectric module is in contact with the beverage container thereby drawing heat from the beverage container. A fan assembly draws heat away from the sleeve. An example of such a system is shown in U.S. Pat. No. 6,530,232 to Kitchens.

SUMMARY OF THE INVENTION AND ADVANTAGES

A thermoelectric heat transfer system is provided for establishing a desired temperature in a climate-controlled area. The system comprises a coolant circuit with a pump in fluid communication with the coolant circuit to circulate coolant. A first heat exchanger is in fluid communication with the coolant circuit to remove heat from the coolant. A second heat exchanger includes at least one thermally conductive conduit in fluid communication with the coolant circuit and at least one thermally conductive fin disposed outside of the coolant circuit. A thermoelectric module is disposed between the at least one conduit and the at least one fin to create a temperature differential between the at least one conduit and the at least one fin. A fan assembly is provided to convey air through the at least one fin into the climate-controlled area to establish the desired temperature within the climate-controlled area.

One advantage of this thermoelectric heat transfer system is the integration of the thermoelectric module into the second heat exchanger. By integrating the thermoelectric module into the second heat exchanger, the fan assembly can simply convey ambient air through the second heat exchanger across the cooled fin into the climate-controlled area to cool the climate-controlled area.

A thermoelectric heat transfer system for establishing a desired temperature of at least one item is also provided. This system also includes a coolant circuit with a pump in fluid communication with the coolant circuit to circulate coolant and a first heat exchanger in fluid communication with the coolant circuit to remove heat from the coolant. However, in this system, a sleeve is adapted to receive the at least one item. The sleeve includes a manifold in fluid communication with the coolant circuit. Here, a thermoelectric module is disposed within the sleeve to create a temperature differential between the manifold and the at least one item to establish the desired temperature of the at least one item.

One advantage of this thermoelectric heat transfer system is the addition of the coolant circuit in a sleeve-type cooler. By using the coolant circuit with the first heat exchanger, greater cooling efficiency can be obtained for the system.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a thermoelectric heat transfer system for use in establishing a desired temperature in a climate-controlled area is shown generally at 10.

Figure 1:
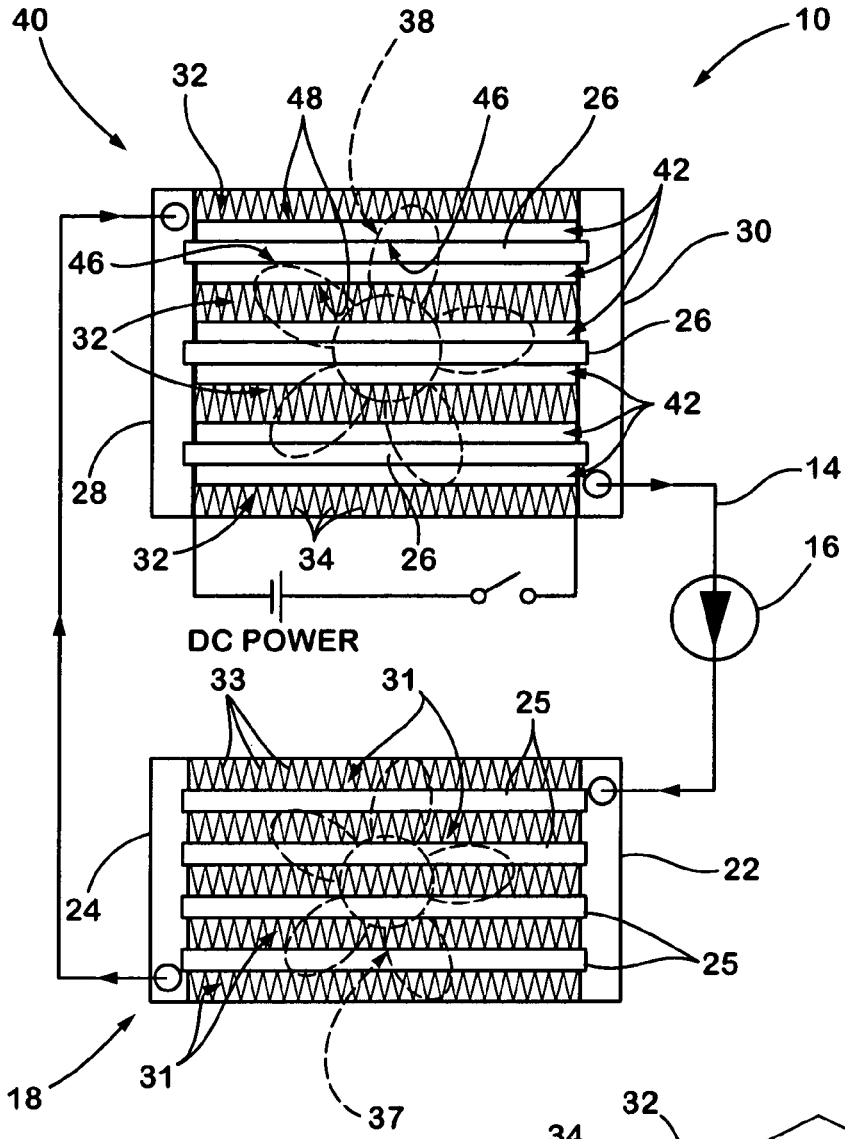
FIG. 1 is a schematic view of a thermoelectric heat transfer system of the present invention.

Referring to the schematic view of FIG. 1, the thermoelectric heat transfer system 10 comprises a coolant circuit 14 and pump 16 in fluid communication with the coolant circuit 14 to circulate coolant. Preferably, the coolant being circulated is an environmentally friendly coolant such as a water-glycol solution. Of course, other coolants capable of heat transfer, including water, could also be used.

A first heat exchanger 18 is in fluid communication with the coolant circuit 14 to remove heat from the coolant being circulated. The first heat exchanger 18 is a conventional air-cooled heat exchanger 18 similar to condensers found in automotive HVAC systems. The first heat exchanger 18 includes an inlet tank 22 and an outlet tank 24 in fluid communication with the coolant circuit 14 and a plurality of flat, thermally conductive conduits 25 or tubes fluidly interconnecting the tanks 22, 24. Convoluted, thermally conductive fins 31 are disposed outside of the coolant circuit 14. Each of the convolutions 33 of the fins 31 includes a plurality of louvers (not shown). Preferably, the conduits 25 and fins 31 are alternately arranged in a stacked configuration. The fins 31, which are well understood by those skilled in the art, are thermally conductive and are in thermal contact with the flat conduits 25 and the coolant flowing therethrough. As a result, heat from the coolant is transferred to the fins 31 and a fan assembly 37 conveys air through the fins 31 to cool the fins 31 and thus, create a continuous flow of heat from the coolant to the fins 31 thereby removing heat from the coolant.

Figure 1A:
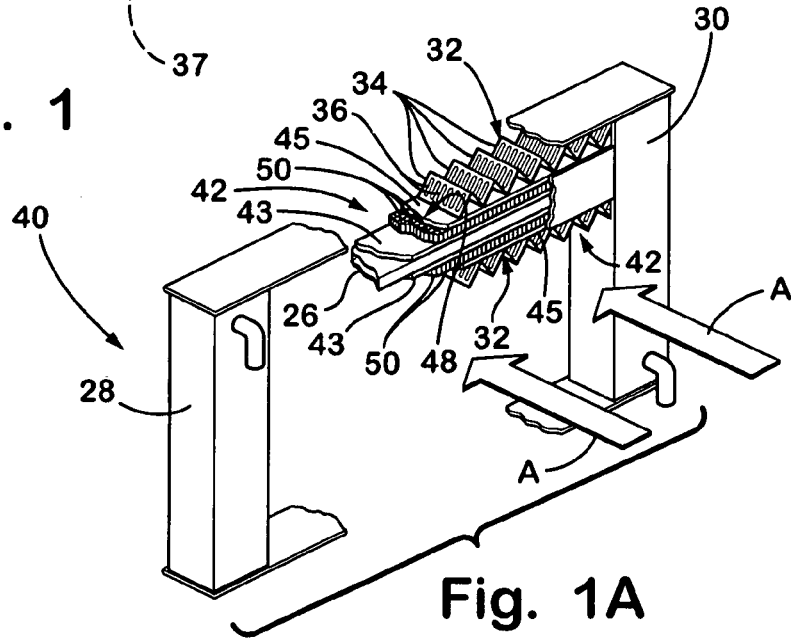
FIG. 1A is a partial, cross-sectional perspective view of a heat exchanger of FIG. 1.

Referring to FIGS. 1 and 1A, a second heat exchanger 40 is also in fluid communication with the coolant circuit 14. Again, similar to the first heat exchanger 18, the second heat exchanger 40 includes a second inlet tank 28 and a second outlet tank 30 in fluid communication with the coolant circuit 14 and a plurality of flat, thermally conductive conduits 26 or tubes fluidly interconnecting the tanks 28, 30. Convoluted, thermally conductive fins 32 are disposed outside of the coolant circuit 14. Each of the convolutions 34 of the fins 32 includes a plurality of louvers 36 (see FIG. 1A). Preferably, the conduits 26 and fins 32 of the second heat exchanger 40 are also alternately arranged in a stacked configuration.

Thermoelectric modules (TEMs) 42 are disposed between the conduits 26 and the fins 32 of the second heat exchanger 40 to create a temperature differential between the conduits 26 and the fins 32. Each of the TEMs 42 includes a first thermally conductive surface 46 in thermal contact with one of the conduits 26 and a second thermally conductive surface 48 in thermal contact with one of the fins 32. The first surface 46 is also referred to as the hot surface 46, and the second surface 48 is also referred to as the cold surface 48. The operation of TEMs 42 is well known in the art and will not be described in detail.

Referring specifically to FIG. 1A, each of the TEMs 42 comprises a pair of plates, a first plate 43 presenting the hot surface 46 and a second plate 45 presenting the cold surface 48. A plurality of thermoelectric elements 50, i.e., N-type and P-type thermoelectric semiconductor elements 50, are arranged in an alternating N-element and P-element configuration between the plates 43, 45, as is well known to those skilled in the art. The thermoelectric elements 50 are coupled electrically in series and thermally in parallel. The Peltier effect occurs when voltage is applied to the N-type and the P-type elements 50 (a DC power source and switch shown in FIG. 1 are used to energize the TEMs 42) resulting in current flow through the serial electrical coupling. The serial current flow results in heat transfer across the N-type and P-type elements and across the plates 43, 45.

Referring back to FIG. 1, the fins 32 extend generally between the tanks 28, 30 of the second heat exchanger 40 and the TEMs 42 extend between the tanks 28, 30 sandwiched between the fins 32 and the conduits 26. The fins 32, conduits 26, and TEMs 42 are arranged in the stacked configuration to maximize the cooling capacity of the second heat exchanger 40. A fan assembly 38 is adapted to convey air through the fins 32 (as shown by the arrows A in FIG. 1A) into the climate-controlled area 12 (see FIG. 2) to establish the desired temperature within the climate-controlled area 12.

Figure 2:
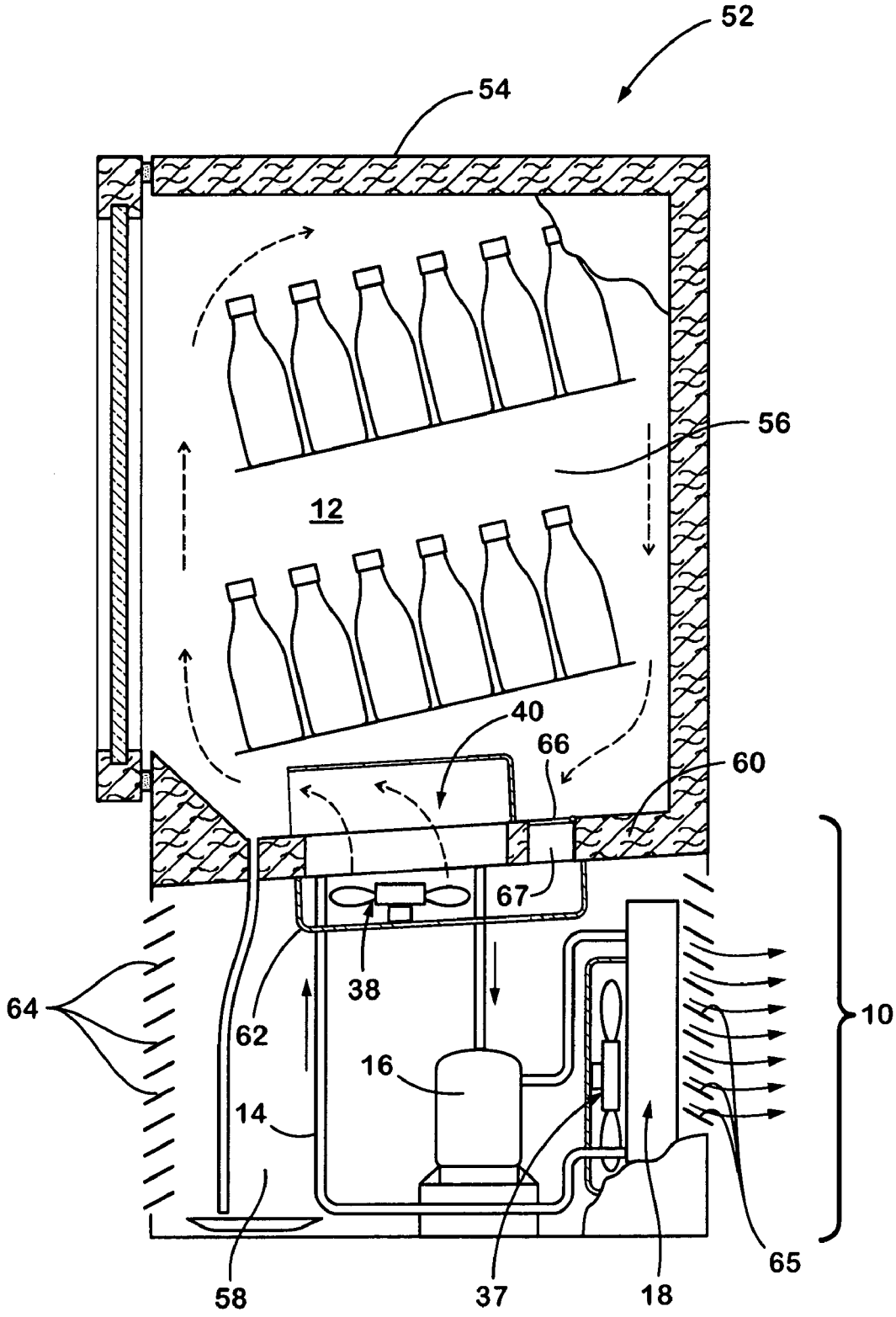
FIG. 2 is a cross-sectional view of a cooler incorporating the thermoelectric heat transfer system of FIG. 1 therein.

Referring to FIG. 2, a cooler 52 incorporating the thermoelectric heat transfer system 10 is shown. The cooler 52 comprises a housing 54 having a first compartment 56 defining the climate-controlled area 12 and a second compartment 58 at least partially isolated from the first compartment 56. The second heat exchanger 40 is laterally positioned in a divider wall 60 between the first compartment 56 and the second compartment 58. The fan assembly 38, which is adapted to convey air through the second heat exchanger 40, is positioned in the second compartment 58. A shroud 62 is fixed to the housing 54 and supports the fan assembly 38 to direct air from the fan assembly 38 during operation through the fins 32 of the second heat exchanger 40 into the climate-controlled area 12. The air may be primarily ambient air from outside of the housing 54 (which enters the second compartment 58 through multiple louvers 64) or the air may be a blend of ambient air and cooled air inside the climate-controlled area 12. A pivotable mode door 66 is shown for controlling the blend by controlling the exit rate of cooled air from the climate-controlled area 12 to the fan assembly 38 through a small passage 67. The first heat exchanger 18 is disposed in the second compartment 58 of the housing 54 and its fan assembly 37 is adapted to convey air through the first heat exchanger 18 to outside of the housing 54 through louvers 65.

Preferably, the thermoelectric heat transfer system 10 is used for refrigeration, i.e., cooling the climate-controlled area 12. Nevertheless, in alternative embodiments, when the direction of current flow through the thermoelectric elements 50 is reversed (reverse polarity), the first plate 43 presents a cold surface and the second plate 45 presents a hot surface and the thermoelectric heat transfer system 10 can be used to heat the climate-controlled area 12. In this instance, the hot surface would be in thermal contact with the fins 32 and the cold surface would be in thermal contact with the conduits 26. The fan assembly 38 would then serve to convey ambient air across the fins 32 to heat the climate-controlled area 12. In addition, the first heat exchanger 18 and fan assembly 37 would be employed to heat the coolant, as opposed to removing heat from the coolant, thereby increasing the heating capacity of the second heat exchanger 40. The principle of reversing the current flow through thermoelectric elements to switch between heating and cooling is well known to those skilled in the art and may be useful in heating the climate-controlled area 12 to defrost the climate-controlled area 12, or for other purposes.

A control system (not shown) including a microcontroller may be used to control the thermoelectric heat transfer system 10. Preferably, the control system is operatively connected to the TEMs 42 to control the TEMs 42. The control system is also operatively connected to the fan assemblies 37, 38, pump 16, and the mode door 66 to control their operation, e.g., conveying air, circulating coolant, varying air recirculation rates, etc. It should be appreciated that any conventional components could be utilized to control the thermoelectric heat transfer system 10, as will be appreciated by those skilled in the refrigeration arts.

Figure 3:
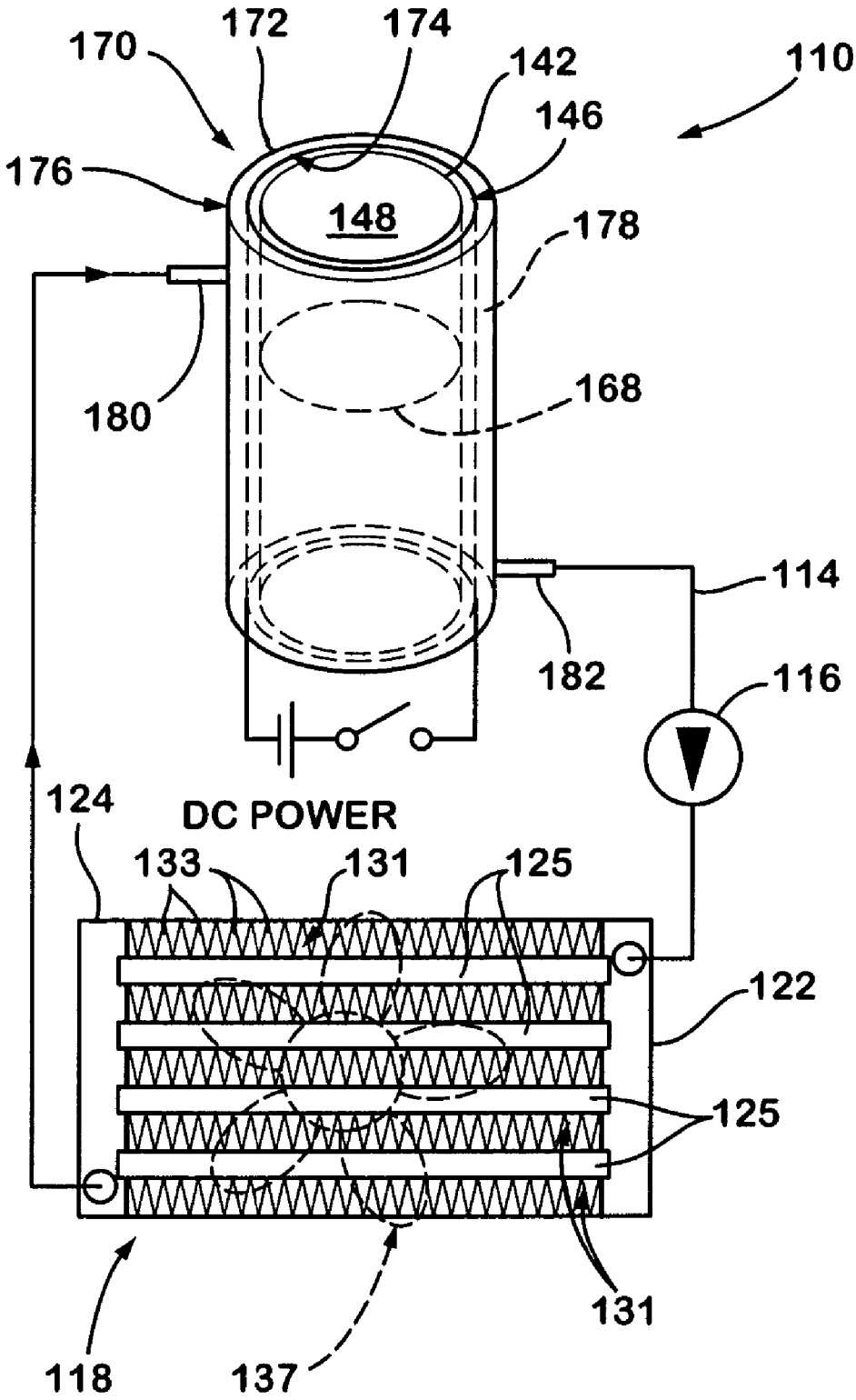
FIG. 3 is a schematic view of an alternative heat transfer system of the present invention.

An alternative thermoelectric heat transfer system 110 is shown in the schematic view of FIG. 3. The alternative thermoelectric heat transfer system 110 is particularly well suited for cooling cylindrically-shaped items 168 such as beverage containers 168 to a desired temperature. Again, using like reference numerals increased by 100 to describe like parts, the alternative heat transfer system 110 includes a coolant circuit 114 and a pump 116 in fluid communication with the coolant circuit 114 to circulate the coolant. A heat exchanger 118 is in fluid communication with the coolant circuit 114 to remove heat from the coolant being circulated. As before, a fan assembly 137 conveys air through the first heat exchanger 118 to cool the coolant flowing through the first heat exchanger 118.

In this embodiment, however, instead of having a second heat exchanger 40 with a configuration similar to the previous embodiment, a sleeve 170 acts as the second heat exchanger. The sleeve 170 is adapted to receive the cylindrically-shaped items 168. The sleeve 170 includes a manifold 172 that is in fluid communication with the coolant circuit 114. The manifold 172 has a cylindrically-shaped inner wall 174 and a cylindrically-shaped outer wall 176 spaced radially outward from the inner wall 174 with an annulus 178 defined therebetween. The outer wall 176 defines an inlet 180 and an outlet 182 for passing the coolant through the annulus 178.

Here, the thermoelectric module 142 is disposed within the sleeve 170 to create a temperature differential between the manifold 172 and the beverage container 168 to establish the desired temperature of the beverage container 168. The thermoelectric module 142 is annular in shape with the first surface 146 being in thermal contact with the inner wall 174 and the second surface 148 contacting the beverage container 168. The first surface 146, e.g., the hot surface 146, contacts the inner wall 174 to transfer heat from the first surface 146 to the coolant that is circulating through the annulus 178 of the manifold 172. The second surface 148, e.g., the cold surface 148, contacts the beverage container 168 to cool the beverage container 168, i.e., the second surface 148 is in thermal contact with the beverage container 168.

Figure 4:
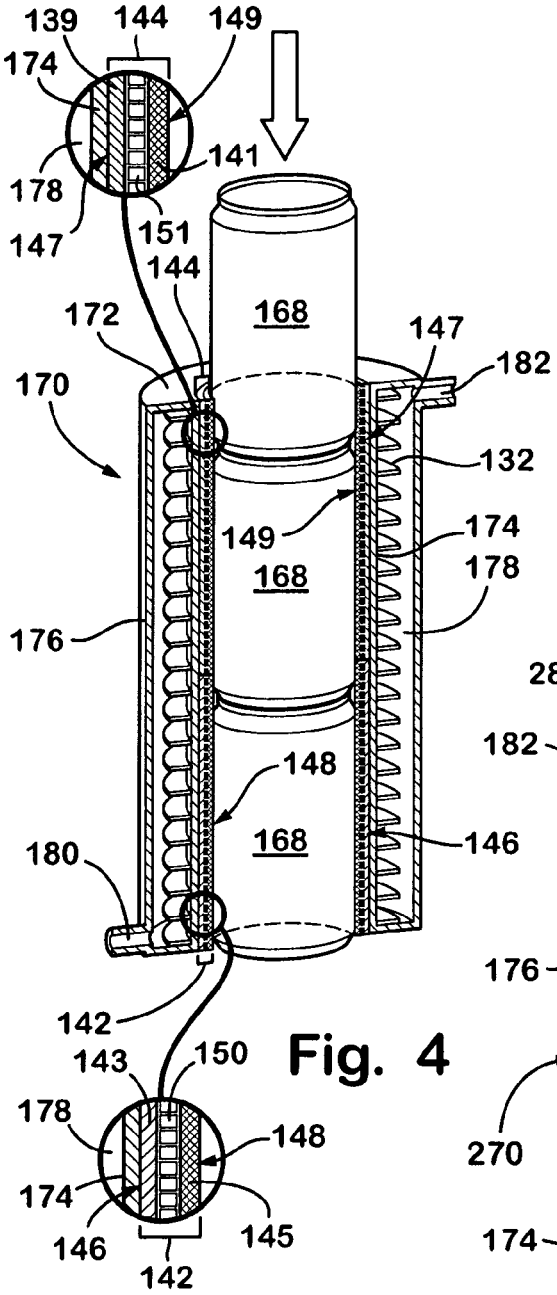
FIG. 4 is a cross-sectional perspective view of a sleeve of the alternative heat transfer system.

Referring to FIG. 4, a thermally conductive fin 132 is used to facilitate the transfer of heat from the first surface 146 to the coolant. The fin 132 is disposed in the annulus 178 and wrapped about the inner wall 174. Preferably, the fin 132 is wrapped in a helical shape along a length of the inner wall 174 to transfer the heat from the first surface 146 to the coolant. It should be appreciated, that in other embodiments, multiple fins 132 wrapped about the inner wall 174 could also be employed. Here, the fin 132 is not only effective in providing a large surface area to draw heat from the first surface 146 of the TEM 142, the fin 132 is also effective in providing turbulence in the coolant flow from the inlet 180 to the outlet 182 to further improve the efficiency of the system 110.

Still referring to FIG. 4, a second thermoelectric module (TEM) 144 adjoining the first TEM 142 is disposed within the sleeve 170. Again, as with the first TEM 142, the second TEM 144 includes a first plate 139 presenting a first surface 147, e.g., hot surface 147, in thermal contact with the inner wall 174 and a second plate 141 presenting a second surface 149, e.g., cold surface 149, in thermal contact with the beverage containers 168 with a plurality of thermoelectric elements 151 disposed between the plates 139, 141. The second TEM 144 is stacked above the first TEM 142 such that approximately one-half of the sleeve 170 is thermally controlled by the first TEM 142 and the other one-half is thermally controlled by the second TEM 144. The second TEM 144 has a thermal capacity or rating that is different than a thermal capacity or rating of the first TEM 142. For this reason, as the plurality of the items 168 (here beverage containers 168) move through the sleeve 170 (such as in a vending machine in which the beverage cans cycle through the sleeve 170) one of the thermoelectric modules 142, 144 is capable of providing greater cooling capacity than the other of the thermoelectric modules 142, 144. Preferably, when the beverage containers 168 are moving through the sleeve 170 in the direction shown in FIG. 4, the second TEM 144 has a higher cooling capacity than the first TEM 142 to provide greater cooling of the beverage containers 168 when first placed in the sleeve 170.

Figure 5:
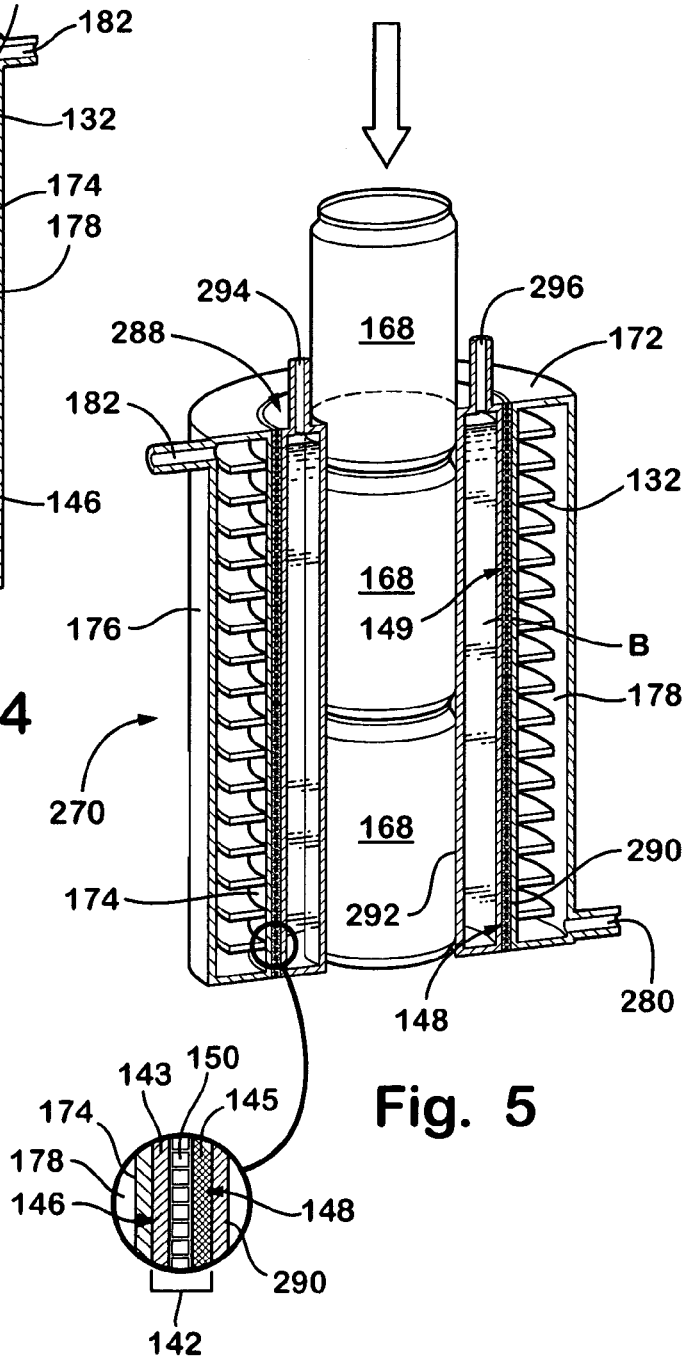
FIG. 5 is a cross-sectional perspective view of an alternative sleeve of the alternative heat transfer system.

Referring to FIG. 5, an alternative sleeve 270 is shown for use in the alternative thermoelectric heat transfer system 110. In this embodiment, the components of the thermoelectric heat transfer system 110 described with reference to FIG. 4 remain the same, except that a reservoir 288 is now positioned between the first 142 and second 144 TEMs and the beverage containers 168. In this embodiment, the reservoir 288 is filled with brine B to serve as a buffer and insulator for the beverage containers 268. The reservoir 288 has an outer reservoir wall 290 in thermal contact with the second surface 148, 149 of the TEMs 142, 144 and an inner reservoir wall 292 in thermal contact with the beverage containers 168. The reservoir 288 assumes a similar annular shape to that of the manifold 172, complete with a reservoir inlet 294 and reservoir outlet 296. However, the inlet 294 and outlet 296 of the reservoir 288 merely serve to fill more brine B in the reservoir 288 and not for circulation. That is not to say, however, that in other embodiments, the brine could not be circulated.

Figure 6:
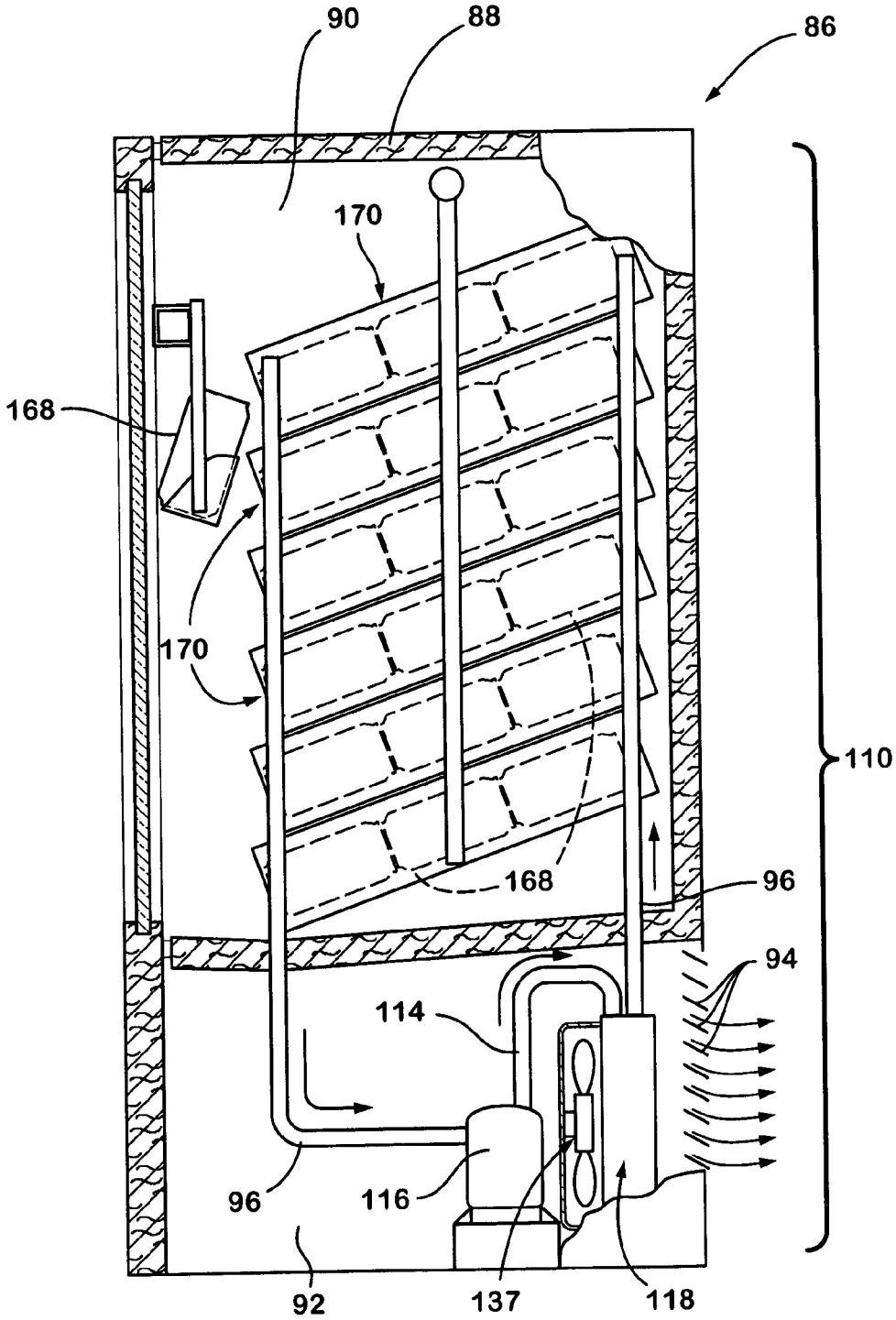
FIG. 6 is a cross-sectional view of a cooler incorporating the alternative heat transfer system.

Referring to FIG. 6, a vending machine 86 incorporating the alternative thermoelectric heat transfer system 110 is shown. The vending machine 86 includes a housing 88 having a first compartment 90 with a plurality of the sleeves 170 disposed therein and a second compartment 92 at least partially isolated from the first compartment 90. The sleeves 170 are oriented to facilitate the vending of the beverage containers 168 therefrom. The first heat exchanger 118 is disposed in the second compartment 92 and the fan assembly 137 is adapted to convey air through the first heat exchanger 118 to outside of the housing 88 through louvers 94. The inlets 180 and outlets 182 of the manifolds 172 for each of the sleeves 170 are connected in fluid conduits 96 that extend to the first heat exchanger 118 and the pump 116, respectively.

The fins 31, 131, 32, 132, conduits 25, 125, 26, manifolds 172, and reservoir 288 are preferably formed from thermally conductive material such as metal, and more preferably, aluminum or copper. The inlet 22, 28 and outlet 24, 30 tanks may be formed of aluminum or copper, and may also be formed of fiber reinforced plastic (FRP). The coolant circuits 14, 114 (including the fluid conduits 96) preferably comprise flexible hoses interconnecting the heat exchangers 18, 40 and pump 16 in FIG. 1 and the heat exchanger 118, pump 116, and manifold 170 in FIG. 3.

Obviously, many modifications and variations of the present invention are possible in light of the above teachings. The invention may be practiced otherwise than as specifically described within the scope of the appended claims.

What is claimed is:

1. A thermoelectric heat transfer system for establishing a desired temperature of at least one item, comprising:

a coolant circuit, a pump in fluid communication with said coolant circuit for circulating coolant through said coolant circuit, a first heat exchanger in fluid communication with said coolant circuit for removing heat from the coolant being circulated through said coolant circuit, a sleeve adapted to receive the at least one item and including a manifold in fluid communication with said coolant circuit, a first unitary thermoelectric module disposed within said sleeve for creating a temperature differential between said manifold and the at least one item to establish the desired temperature of the at least one item, said thermoelectric module being annular in shape such that in operation the resulting temperature differential is produced between the region corresponding to the inner diameter and the region corresponding to the outer diameter of the first thermoelectric module, and said first thermoelectric module completely surrounds the item circumferentially, and a second unitary thermoelectric module disposed within said sleeve for creating a temperature differential between said manifold and the at least one item to establish the desired temperature of the at least one item, said second thermoelectric module being annular in shape such that in operation the resulting temperature differential is produced between the region corresponding to the inner diameter and the region corresponding to the outer diameter of the second thermoelectric module, and said second thermoelectric module completely surrounds the item circumferentially, wherein said second thermoelectric module is disposed with respect to the first thermoelectric module such that the item can be advanced through the two thermoelectric modules sequentially, and wherein said second thermoelectric module has a thermal capacity that is different than a thermal capacity of said first thermoelectric module such that as a plurality of the items move through said sleeve one of said thermoelectric modules is capable of providing greater cooling capacity than the other of said thermoelectric modules.

2. The thermoelectric heat transfer system as set forth in claim 1 wherein said manifold includes an inner wall and an outer wall with an annulus defined therebetween and said outer wall defines an inlet and an outlet for passing the coolant through said annulus.

3. The thermoelectric heat transfer system as set forth in claim 2 wherein said first and second thermoelectric modules each include a first surface in thermal contact with said inner wall and a second surface adapted for being in thermal contact with the at least one item.

4. The thermoelectric heat transfer system as set forth in claim 3 including at least one thermally conductive fin wrapped about said inner wall in said annulus.

5. The thermoelectric heat transfer system as set forth in claim 4 wherein said at least one fin is wrapped in a helical shape along a length of said inner wall for transferring heat from said first surface to the coolant.

6. The thermoelectric heat transfer system as set forth in claim 3 including a reservoir having an outer wall in thermal contact with said second surface and an inner wall adapted for being in thermal contact with the at least one item.

7. The thermoelectric heat transfer system as set forth in claim 6 wherein said reservoir is filled with brine whereby said second surface and said brine are in thermal contact with the at least one item to cool the at least one item.

8. The thermoelectric heat transfer system as set forth in claim 1 including a fan assembly for conveying air through said first heat exchanger to cool the coolant flowing through said first heat exchanger.

9. The thermoelectric heat transfer system as set forth in claim 8 including a housing having a first compartment with a plurality of said sleeves disposed therein and a second compartment at least partially isolated from said first compartment with said first heat exchanger being disposed in said second compartment and said fan assembly being adapted to convey the air through said first heat exchanger to outside of said housing.

* * * * *